United States Patent [19]

Held

[11] 3,974,819

[45] Aug. 17, 1976

[54] STARTING DEVICE FOR A ROCKET AIRCRAFT FOR PLAYING OR LEARNING PURPOSES

[76] Inventor: Hans Held, 8121 Wessobrunn-Haid, Germany

[22] Filed: Oct. 31, 1974

[21] Appl. No.: 522,703

[30] Foreign Application Priority Data

Nov. 2, 1973 Germany ..... 2354965

[52] U.S. Cl. ..... 124/17; 124/31; 46/74 B; 46/76 A

[51] Int. Cl.[2] ..... F41B 7/00

[58] Field of Search ..... 46/74 B, 81, 76 A; 124/35, 41, 17, 31; 244/63; 89/1.806, 1.807, 1.808

[56] References Cited

UNITED STATES PATENTS 1,572,270 2/1926 Dwyer ..... 124/17 X 3,408,768 11/1968 Glass et al. ..... 46/81

FOREIGN PATENTS OR APPLICATIONS 388,139 1965 Switzerland ..... 89/1.806

*Primary Examiner*—Richard C. Pinkham
*Assistant Examiner*—William R. Browne
*Attorney, Agent, or Firm*—Michael J. Striker

[57] ABSTRACT

A stretched elastic pull element for launching a toy rocket glider is released by the action of the rocket propulsion gas discharge acting against a control plate disposed in the path of said discharge. The control plate, being connected to the holder, pivots under action of a discharged gas and causes the locking element to be released and permit the elastic pull element to act on the rocket glider.

4 Claims, 3 Drawing Figures

STARTING DEVICE FOR A ROCKET AIRCRAFT FOR PLAYING OR LEARNING PURPOSES

Figure 1:
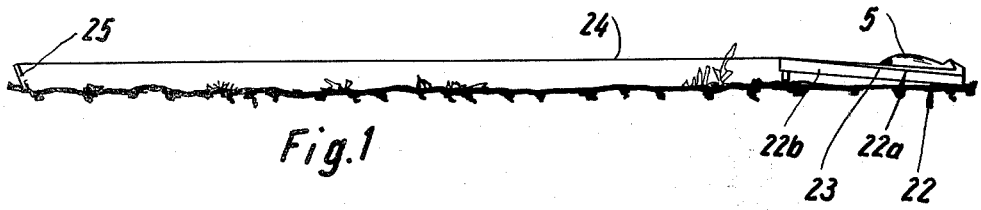

The invention relates to a starting device for an aircraft equipped with a rocket motor and intended for playing or learning purposes.

The object of the invention is the provision of a starting device by means of which the aircraft is retained in its starting position until the discharging propulsion gases of the rocket motor unlock the starting device.

The invention accomplishes this object by providing a control plate at a distance behind the propulsion gas discharge opening of the rocket motor and in a position approximately perpendicular to its longitudinal axis. The control plate is attached to a holder. Said control plate being movably constructed so that when pushed by propulsion discharge gas, it causes the release of a locking element which can be coupled to the rear end of the aircraft which is under the action of the pull applied by a stretched elastic pull element.

Locking between the starting device and the aircraft can be provided by a hook-shaped locking element which in the locking position engages an opening at the end of the pivotable control plate through a linkage.

In a further embodiment of the invention, the control plate is suspended from a horizontal pivoting axis of the holder extending transversely to the starting direction of the aircraft, one end of a connecting rod being jointed to the rear of the control plate, the other end of the said connecting rod acting on one air of a rocket lever whose arm comprises the hook-shaped locking element and whose pivoting axis is disposed at a distance and parallel to the pivoting axis of the control plate. The pivoting axes of the control plate and of the rocker lever can extend freely through the top or bottom end of an aperture which is provided in a section of the holder which is oriented at an upward angle in the starting direction of the aircraft and merges via an offset portion into a vertical insertion end which can be inserted into a bore in the outside of the bottom of a storage container for the aircraft.

The elastic pull element can be detachably mounted on a ground post which in its operating position is inserted in the ground at a distance in front of the aircraft while the other end of the pull element can be connected with a starting hook attached to the aircraft. The pull of the pull element is therefore added to the thrust of the rocket so that after the aircraft starts the pull element drops off the starting hook and is available for a fresh start. The outside of the bottom of one half of the storage container together with the outside of the bottom of the other half of the storage container forms a flat starting track, the distal end of which with respect to the starting direction contains the insertion bore for the starting release. The two container halves are appropriately joined to each other on one narrow side by means of a hinge so that they can pivot through 180° with respect to each other.

In a further embodiment for a rocket aircraft with rocket motors disposed in two planes one above the other, a separating plate can be inserted between the rocket motor or rocket motors disposed in the top plane, said plate extending rearward under the control plate. Since the plate is only loosely inserted between the rocket motors it will detach itself automatically when the aircraft starts.

Figure 2:
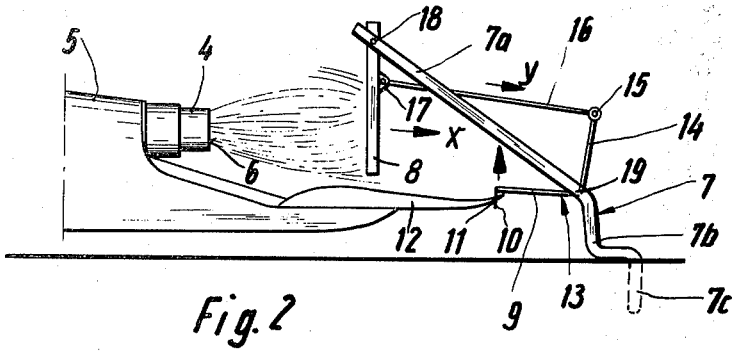
Figure 3:
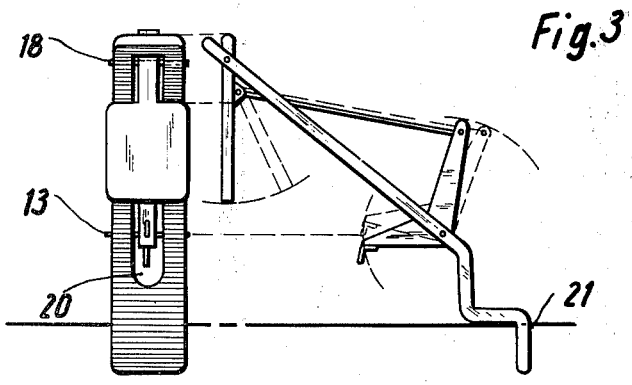

One embodiment of the invention is illustrated in the accompanying drawing, in which:

FIG. 1 is the starting device in the operating position shown as a diagrammatic view, FIG. 2 shows part of the starting device and the aircraft in an enlarged view, FIG. 3 as a composite view of the starting device with control plate from both the side and the front.

The illustrations show a starting device for an aircraft 5 for playing or learning purposes with a rocket motor 4, a control plate 8 being provided on a holder 7 at a distance behind the propulsion gas aperture 6 of the rocket motor approximately perpendicularly to its longitudinal axis, said plate being movably constructed so that when pushed with propulsion gas releases a locking element 9 which can be coupled to the rear end of the aircraft. The locking element 9 is provided with a hook 10 which is downwardly oriented and engages in an insertion opening 11 in the rear edge of a section surface 12 of the aircraft 5. The hook-shaped locking element 9 forms one arm of a rocker lever 13 whose other arm 14 points outwardly and whose free end is jointed at 15 to a connecting rod 16 which is jointed at 17 to the upper half of the rear of the control plate 8. The top end of the control plate is pivotable about an axis 18 which, in the same way as the axis 19 of the rocker lever 13, extends through an opening 20 in the holder 7. An opening 20 is provided in a top part **7*a* of the holder which is pointed upwardly at an angle in the direction of the flight path the said part merging through an offset portion 7*b* into a vertical insertion end 7*c* which can be inserted into an insertion opening 21 in the outside of the bottom of a storage container 22** for the aircraft.

The outside of the bottom of one container half **22*a* together with the outside of the bottom of the other half 22*b* of the container forms a plane-surface runway whose end, which is distal with respect to the starting direction, is provided with the insertion bore 20 for the starting release. On their narrow side, the containers are pivotably connected to each other by means of a hinge 23 so as to be pivotable through 180°. The container is shown in FIG. 1 in the open position as a runway, the aircraft being disposed in the locked position shown in detail in FIG. 2 and being secured on a ground post 25 by means of a rubber cord 24** after the cord has been extended.

The propulsion gases of the ignited rocket strike the control plate 8 and pivot this to the rear in the direction of the arrow *x* so that the connecting rod 16 pivots the rocker lever 13 clockwise in the direction of the arrow *y*. This causes the hook to be lifted from the insertion opening 11 in the rear edge of the section surface of the aircraft 5 so that the latter is propelled into the air under the action of the propulsion gases discharged from the rocket and by virtue of the pull applied by the extended rubber cord 24. The loose end of the rubber cord is subsequently released by the starting hook of the aircraft. In this way the relatively short runway comprising the outside of the bottoms of the opened storage container are sufficient to achieve the necessary starting speed.

In the event that one or more rocket motors are provided in the aircraft under the rocket motor 4 for ignition after cut-off of the top rocket 4, it is appropriate to insert a sheet metal plate between the top rocket motor or motors and those disposed below, the plate extending rearwardly under the control plate. This ensures that only the propulsion gases of the rocket motor disposed in the top plane strike the control plate.

The starting device described herein can also be correspondingly applied to vertical-take-off aircraft, for example rockets or the like. Furthermore, where appropriate, the end of the rubber cord which leads in the starting direction can also be mounted on the storage container itself.

Having described my invention, I claim:

1. A starting device for a toy aircraft having a front end and a rear end, comprising, a rocket motor adapted to be mounted on the toy aircraft in the region of its rear end and having a rearwardly directed propulsion gas discharge aperture having a longitudinal axis adapted to extend lengthwise of the toy aircraft; a stretched elastic pull element releasably connectable to the front end of the toy aircraft; and holder means for temporarily holding the toy aircraft stationarily against the combined force of said rocket motor and said pull element and including a stationary holder, a hook-shaped locking element movable between a locking position in which it engages the toy aircraft in the region of its rear end and a releasing position, a control plate pivotally mounted in the region of one end thereof on said holder rearwardly of the discharge aperture and normally extending substantially normal to the longitudinal axis thereof and movable from said normal to an inclined position when propulsion gas emanating from said discharge aperture impinges thereon, and linkage means pivotally mounted on said holder and connected to said control plate and said locking element for moving the latter to said releasing position upon movement of said control plate to said inclined position so that the toy aircraft may start under the combined action of said rocket motor and said pull element.

2. A starting device as defined in claim 1, wherein said linkage means comprises a bell crank pivotally mounted on said holder and having a first arm carrying on the free end thereof said locking element, and a connecting rod pivotally connected at one end to said control plate in the region of the upper end of the latter and at the other end to the free end of a second arm of said bell crank so as to increase the turning moment by means of which said locking element is moved to said releasing position.

3. A starting device as defined in claim 2, including a runway provided with a bore, and wherein said holder comprises an upwardly sloping portion provided with an elongated opening, a substantially horizontal portion connected to one end of said sloping portion and abutting against said runway, and a substantially vertical portion inserted in said bore of said runway, and further including pivot pins for said control plate and said bell crank extending transversely through said elongated opening of said sloping holder portion.

4. A starting device as defined in claim 1, wherein said elastic pull element comprises an elastic rubber cord connected at one end to said front end of the toy airplane, and including a post inserted in the ground forwardly of said toy aircraft, the other end of said cord being connected to said post.

* * * * *